United States Patent [19]

Moore

[11] 4,142,259

[45] Mar. 6, 1979

[54] INVALID BATHING ASSEMBLY

[76] Inventor: Helen B. Moore, Rte. 2, Elmore City, Okla. 73035

[21] Appl. No.: 875,131

[22] Filed: Feb. 6, 1978

[51] Int. Cl.[2] ..... A47K 3/06; A47K 3/062

[52] U.S. Cl. ..... 4/177 R; 4/185 R; 4/185 L; 5/331; 5/63

[58] Field of Search ..... 4/177, 176, 175, 174, 4/173 M, 185 R, 185 HB, 185 L; 5/331, 63; 128/66

[56] References Cited

U.S. PATENT DOCUMENTS

| | | | |
|---|---|---|---|
| 2,644,173 | 7/1953 | James | 5/331 |
| 2,763,873 | 9/1956 | Saunders | 128/66 X |
| 2,871,490 | 2/1959 | Balonick | 5/331 |
| 2,891,258 | 6/1959 | Reichert | 5/331 |
| 3,059,250 | 10/1962 | Mayer | 5/331 |
| 3,063,066 | 11/1962 | Peck et al. | 5/331 |
| 3,179,957 | 4/1965 | Norton | 5/331 |
| 3,246,346 | 4/1966 | Schmidt | 4/177 |
| 3,336,606 | 8/1967 | Beitzel | 5/331 |
| 3,373,451 | 3/1968 | Schmidt | 4/177 |
| 3,803,647 | 4/1974 | Reswick | 4/185 L X |
| 4,062,074 | 12/1977 | Holland | 5/63 |
| 4,078,269 | 3/1978 | Weipert | 5/63 |

*Primary Examiner*—Henry K. Artis
*Attorney, Agent, or Firm*—William R. Laney

[57] ABSTRACT

An assembly for bathing an invalid person comprising an adjustable bed frame including a pair of opposed, substantially parallel side portions and a horizontally extending bottom portion. A mattress is supported on the bottom portion of the frame between the side portions, and a water deflecting flexible sheet is detachably secured to the upper edges of the side portions of the frame. A manually actuated lever subassembly is operatively connected to the side portions of the frame for selectively latching the side portions of the frame in a raised or elevated status relative to the bottom portion of the frame during the bathing of a reclining person. A hydraulic lift subassembly adjustably supports the entire frame above a base platform.

18 Claims, 5 Drawing Figures

INVALID BATHING ASSEMBLY

BACKGROUND OF THE INVENTION

1. Field of the Invention

This invention relates to devices useful in the care and treatment of incapacitated persons, and more particularly, to a bathing assembly which can be used to advantage in washing and cleansing persons who have difficulty in ambulating, and/or sitting in an upright position.

2. Brief Description of the Prior Art

A number of devices have previously been proposed to facilitate the bathing of hospital patients in instances where they cannot easily walk to a bathroom, or where such patients are bedfast and even are prevented by injury or disease from sitting in an upright position. Devices of this type generally contemplate bathing of the incapacitated person with relatively little change from the positional status of that person in undergoing treatment or convalescence, which is usually a bedfast status. The devices previously proposed for this purpose also generally make due allowance for the physical difficulties entailed in lifting and moving such persons from a bed to a location where the bathing is to be accomplished.

As an example of some of the devices which have been proposed for bathing patients in hospitals, such a system is disclosed in Bernier U.S. Pat. No. 1,451,437 which includes a sheet of waterproof material positioned above a mattress and adapted to be connected to side frame members of the bed, which frame members are elevatable. Elevation of the frame members to which the waterproof material is attached is accomplished by a tubular telescoping arrangement in which tubes forming a portion of the frame members to which the waterproof material is attached are caused to slide up and down within slightly larger fixed or stationary tube members.

Saunders U.S. Pat. No. 2,763,873 describes a bath which is superimposed upon a bed, and includes a crank mechanisn for elevating the head of the bed so that the head of the patient is maintained well above the water level during bathing.

Scroggin U.S. Pat. No. 1,263,611 describes a bathing apparatus supported upon a frame and capable of vertical adjustment in relation to the frame.

Other patents of interest in the area of bathing structures previously proposed for use in bathing incapacitated persons include those disclosed in Stowe U.S. Pat. No. 568,811; Blimberg U.S. Pat. No. 2,329,326; Boward U.S. Pat. No. 2,471,302; Burrow U.S. Pat. No. 3,504,646; Hoffman U.S. Pat. No. 2,567,514; Schmidt U.S. Pat. Nos. 3,246,346; 3,373,451 and 3,557,392; and Hoxeng et al. U.S. Pat. No. 3,334,360.

BRIEF DESCRIPTION OF THE PRESENT INVENTION

The present invention provides an improved bathing assembly which is particularly useful for the bathing of patients who have little mobility, and must be bathed either in the bed to which they are confined, or must be carefully moved without jostling to a location closely adjacent the bed to which they are confined, and bathed while in a reclining or, at best, sitting status. The bathing assembly of the invention can be very easily used by personnel having little or no knowledge of mechanics, and does not require great strength on the part of a nurse, orderly or other person to operate the assembly.

Broadly described, the bathing assembly of the invention, useful for bathing invalid or incapacitated persons, comprises an adjustable bed frame which is supported upon a hydraulic lift assembly which, in turn, is supported upon a base platform preferably mounted on casters, rollers or the like. The adjustable bed frame, supported at a selected heighth over the base platform by a hydraulic lift subassembly, includes a pair of parallel side portions which are positioned on opposite sides of a mattress or the like which rests upon a horizontally extending bottom portion of the bed frame. The side portions are movably supported above the bottom portion of the frame and can be elevated and lowered in relation to the bottom portion. The side portions are each provided with means by which a water deflecting flexible cover sheet can be secured thereto to form a tub-like configuration over the mattress. A manually actuated lever subassembly is operatively connected between the side portions of the frame and the bottom portion thereof for selectively latching the side portions of the frame in an elevated or raised status relative to the bottom portion during the bathing of the patient.

An important advantage of the present invention is the ease with which the bathing assembly may be converted from a comfortable bed for supporting a patient in the manner in which the bedfast patients are commonly accommodated in hospitals and affording all of the access and comfort usually associated with the hospital bed, to a bathing assembly for bathing the patient, all without the necessity for removing the patient from the bed.

An object of the invention of considerable importance is the provision of a very easily used bathing assembly for bathing invalid or incapacitated persons in a safe and sanitary fashion and without spilling water from the bathing locus onto the floor or areas surrounding the bathing assembly.

A further object of the invention is to provide an invalid bathing assembly by means of which incapacitated persons can be quickly and comfortably bathed in a bodily position which does not cause pain or impose strain upon the person, and which does not entail any danger of drowning or ingestion of water by the person.

A further object of the invention is to provide an invalid bathing assembly which can be very easily and effectively used by nurses, or hospital orderlies or other personnel having no special mechanical acumen, or ability to operate complex mechanisms, and even though they are not exceptionally strong physically.

A further object of the invention is to provide a bathing assembly in which persons may be bathed, or may bathe themselves, while in a comfortable reclining position, which assembly is sturdily constructed, mechanically strong and characterized in having a long and trouble free operating life.

In addition to the foregoing described objects and advantages, additional beneficial features and advantages of the bathing assembly of the invention will become apparent as the following detailed description of a preferred embodiment of the invention is read in conjunction with the accompanying drawings which illustrate such preferred embodiment of the invention.

GENERAL DESCRIPTION OF THE DRAWINGS

DETAILED DESCRIPTION OF A PREFERRED EMBODIMENT OF THE INVENTION

Figure 1:
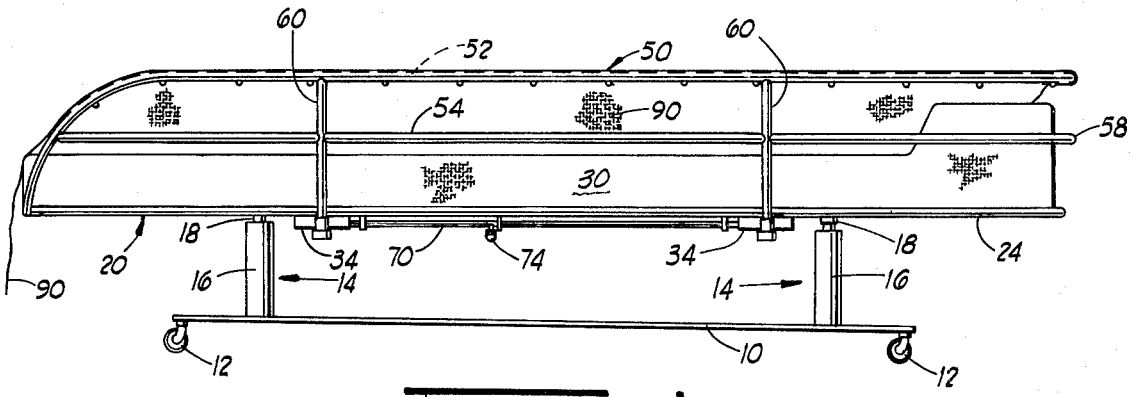
FIG. 1 is a side elevation view of the bathing assembly of the present invention as the assembly appears when used in side elevation.
Figure 2:
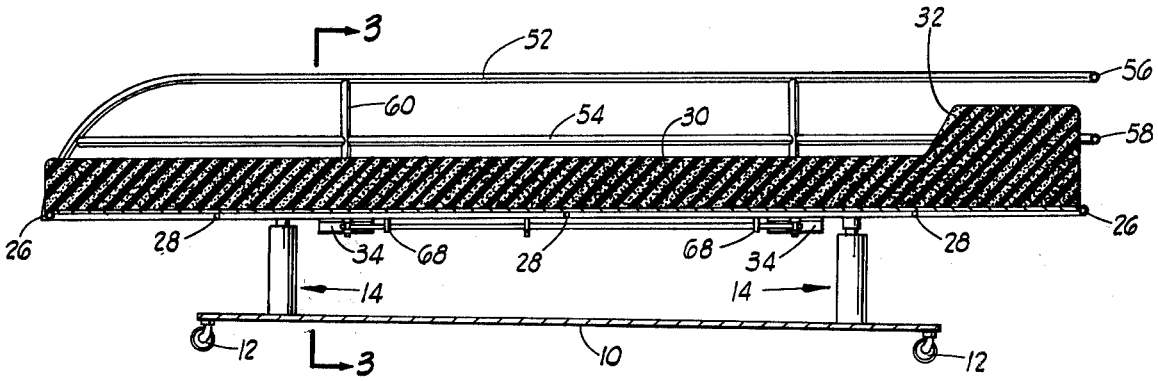
FIG. 2 is a sectional view taken along the longitudinal center line of the bathing assembly of the invention.
Figure 3:
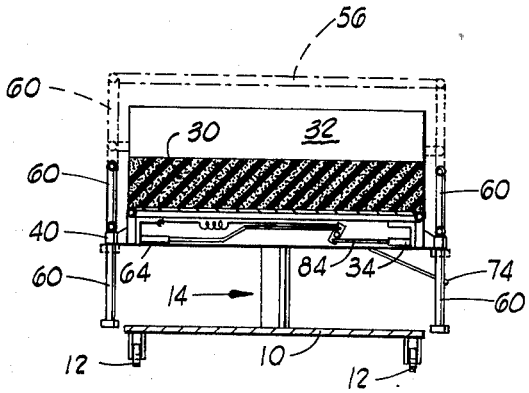
FIG. 3 is a sectional view taken along line 3—3 of FIG. 2.
Figure 4:
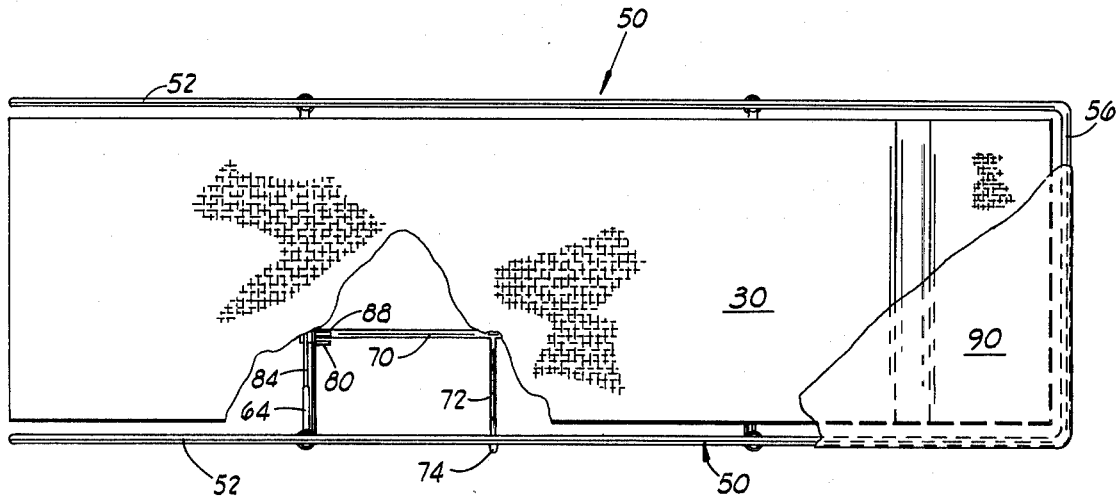
FIG. 4 is a plan view of the bathing assembly of the invention, with a portion of the water deflecting flexible cover member and underlying mattress broken away to illustrate certain portions of an underlying manually operated elevating subassembly forming a part of the bathing assembly.

Referring initially to FIG. 1 of the drawings, the bathing assembly of the invention comprises a horizontally extending base platform 10 which is supported at its opposite ends and sides by a plurality of casters 12. Secured to the upper side of the base platform 10 are a pair of hydraulic lift subassemblies each designated generally by reference numeral 14, and each including a vertically extending cylinder 16 and a piston rod 18 which is extensible therefrom. Each of the hydraulic lift subassemblies 14 is attached to the lower side of a bed frame designated generally by reference numeral 20.

The bed frame 20 includes a pair of horizontally spaced, substantially parallel side portions 22 and a bottom portion 23 which includes a pair of elongated, longitudinally extending rod or tubular frame members 24. At their opposite ends, the tubular frame members 24 are interconnected by a pair of horizontally extending transverse tubular frame members 26. Additional transverse tubular frame members 28 are disposed intermediate the ends of the bed frame 20 and interconnect the longitudinal frame members 24. The bottom portion 23 of the bed frame 20 functions to support a mattress 30 which can be constructed of foam rubber or any other conventional material. The mattress 30 preferably has formed at one end thereof an elevated or raised headrest 32.

Figure 5:
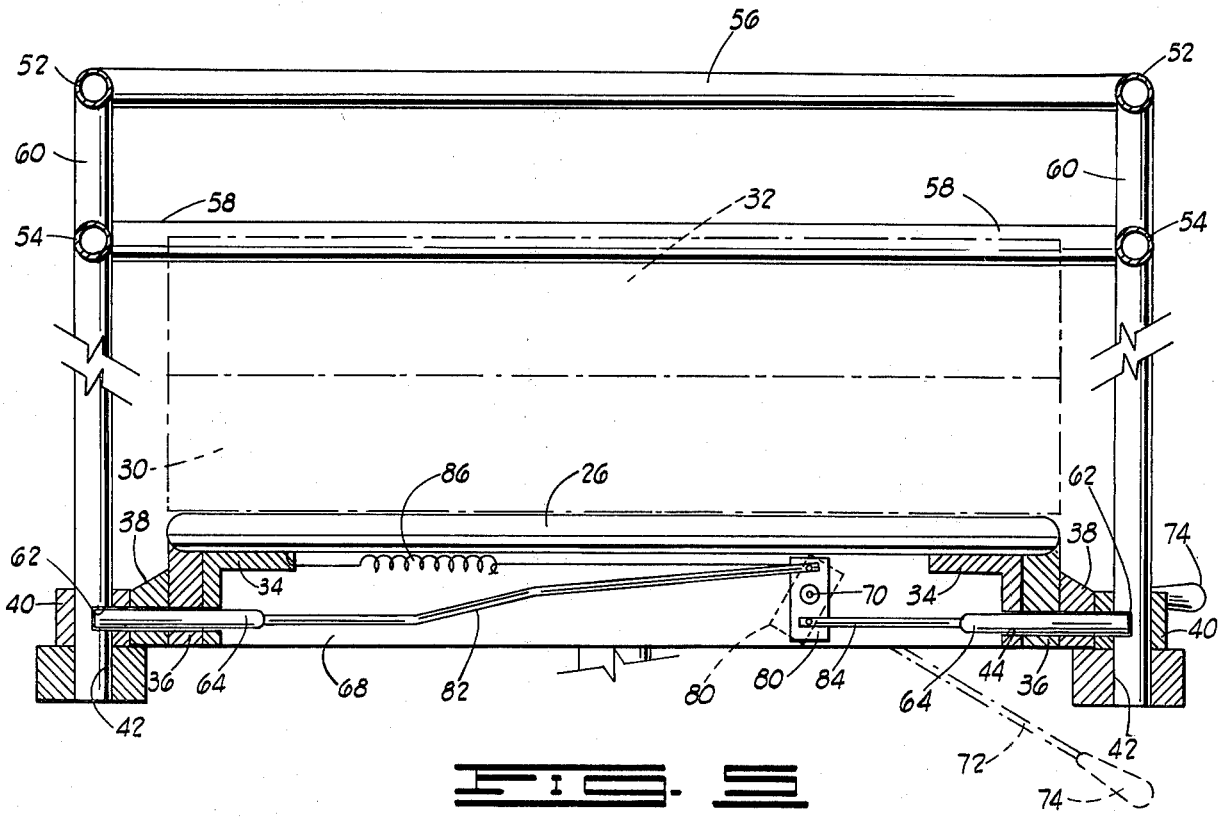
FIG. 5 is a sectional view taken along line 5—5 of FIG. 4.

Secured to the longitudinal tubular frame members 24 at horizontally spaced locations therealong are a pair of downwardly extending angle brackets 34. Each angle bracket 34 is welded or otherwise suitably secured to a reinforcing plate 36 as shown in FIG. 5. A spacer plate 38 is welded to the outer side of each reinforcing plate 36 and is secured to a centrally bored collar element 40 which is positioned in an outwardly facing position on the bed frame 20 as shown in FIG. 1. The bore 42 which extends centrally through each collar element 40 is intersected by a communicating latching pin passageway 44 which extends horizontally through the angle bracket 34, the reinforcing plate 36, the spacer plate 38 and one side of the collar element 40. It will be noted that the pin passageway 44 extends substantially horizontally and the bore 42 extends substantially vertically.

The side portions 22 of the frame are movably supported upon the bottom frame portion 23 of the bed frame 20. The side frame portions 22 extend substantially parallel to each other, and are rigidly interconnected to each other for purposes of concurrent synchronous vertical movement in a manner hereinafter described.

As will be noted in referring to FIGS. 1 and 5, each of the side frame portions 22 includes a pair of substantially elongated, longitudinally extending tubular frame elements 52 and 54. The upper longitudinal frame element 52 carries, adjacent its lower outer side, a plurality of hooks or protuberances 55 which are spaced horizontally and longitudinally along the upper tubular frame member 52 for a purpose hereinafter described. It will be noted that at one end of each of the upper longitudinally extending tubular frame members 52, each frame member is bent downwardly through a relatively large radius bend and is here connected to an end of the respective lower longitudinally extending tubular frame members 54. At its end opposite the downwardly bent end portion, each longitudinally extending upper tubular frame member 52 is connected through a transverse connecting frame member 56 to the longitudinally extending upper frame member 52 at the opposite side of frame 20 and in the other side frame portion 22. Preferably, the two upper longitudinally extending tubular frame members 52 and the transverse interconnecting tubular frame member 54 are formed integrally as a single U-shaped piece by appropriate bending in the course of fabrication. A similar construction characterizes the lower longitudinally extending tubular frame elements 54, and a transversely extending interconnecting frame member 58 by which the lower longitudinally extending tubular frame elements are connected to each other.

Each of the side frame portions 22 further includes a plurality of vertically extending frame elements 60 by which the upper longitudinally extending tubular frame elements 52 and lower longitudinally extending tubular frame elements 54 are interconnected to each other. The vertically extending tubular frame elements 60 project, at their lower ends, into the bores 42 provided in the centrally bored collar elements 40 hereinbefore described. The vertically extending tubular frame elements 60 are thus slidably mounted within the collars 40 to facilitate vertical movement of the side frame portions 22 with respect to the bottom frame portions 23 in a manner and for a purpose hereinafter described.

Each of the vertically extending tubular frame elements 60 has formed therein at a location relatively near to the lower end thereof, a latching pin receiving hole 62 for receiving a latching pin 64 forming a portion of a manually actuated lever subassembly hereinafter described. It will be noted that the hole 62 in each of the vertically extending tubular frame elements 60 is of sufficient size, and is formed at a location in the side of the respective vertically extending tubular frame element, such that the latching pin 64 can be snugly received therein as is shown in FIG. 5. It will also be noted that at the time when the hole 62 is aligned with the latching pin 64, the latching pin can enter the hole and lock the respective vertically extending tubular frame element 60 in a selected position in relation to the bottom frame portion 23. The side frame portions 22 project upwardly to a location such that the upper longitudinally extending tubular frame elements 52 are spaced well above the upper surface of the mattress 30, including the headrest 32.

For the purpose of selectively elevating and lowering the side frame portions 22 of the frame 20, a manually actuated lever subassembly, designated generally by reference numeral 66, is provided. The manually actuated lever subassembly 66 includes transversely extending horizontal bars 68 which extend across the lower side of the bottom portion 23 of the frame 20. Each bar 68 has its opposite ends secured to the lower sides of the longitudinally extending tubular frame members 24. An aperture is provided in each of the bars 68 to permit an elongated control rod 70 of round cross-section to be extended therethrough and supported for rotation about its longitudinal axis.

The control rod 70 has welded or otherwise suitably secured thereto at a point intermediate its length, a control lever 72 which projects laterally of the frame 20 and carries at its outer end, a control handle 74 (see FIG. 5). At each end of the control rod 70, it is welded or otherwise suitably secured to a lever plate 80. Each lever plate 80 (see FIG. 5) is of generally rectangular configuration, and has a first reciprocating rod 82 connected to the lever plate adjacent one edge thereof, and offset from a point near the center of the lever plate 80 where this plate is attached to the control rod 70. A second reciprocating rod 84 is attached to the opposite side of the lever plate 80, and is offset from the point of attachment of the lever plate to the control rod 70. The reciprocating rods 82 and 84 extend transversely with respect to the frame 20, and carry at their ends opposite the ends attached to the lever plate 80, a pair of the latching pins 64 hereinbefore described.

Connected between the upper, horizontally extending flange of the angle bracket 34 and one side of the frame 20 is an elongated, helically turned compression spring 86. Secured to one side of each transverse bar 68 which is nearest to the one of the lever plates 80 is a stop rod 86. The stop rod 86 is positioned to be contacted by a cooperating stop rod 88 carried on, and rotatable with, the control rod 70 at a time when the control rod is rotated, so that the interaction of the stop rods 86 and 88 functions to limit the distance when the stop rod can undergo rotation about its longitudinal axis.

A final element of the bathing assembly of the invention is a sheet of flexible, waterproof or water repellant material which can deflect and channel water used in bathing. The flexible sheet is designated by reference numeral 90 and includes a pair of longitudinal edges which can be extended upwardly over the upper longitudinal frame elements 52 of the two opposite side portions 22 of the frame 20 and engaged with the hooks or protuberances 55. The length of the sheet 90 is such that it extends from one end of the frame 20 to the other; and in fact, it is of sufficient length to permit it to hang downwardly from that end of the frame at which the curved end portions of the upper longitudinal frame elements 52 are located. The flexible sheet 90 when thus engaged with the hooks or protuberances 55 at the upper sides of the upper longitudinal frame elements 52, forms a tub into which water may be poured for the purpose of bathing a patient with the water then being permitted to drain toward the foot of the frame 20 where it can be discharged into a bathtub or similar receptacle.

Operation

In using and operating the bathing assembly of the invention, it may first be mentioned that the assembly, in addition to its utility for bathing a recumbent person who may be incapacitated by injury or illness, functions quite well as a conventional or ordinary bed similar to those presently in use in hospitals. For some patients, it will be unnecessary in this usage to have any side rails or confining structures projecting vertically at opposite sides of the mattress upon which the patient is rested. In such cases, the side portions 22 of the frame 20 may be lowered to a position such that the longitudinally extending upper frame element 52 forming portions of the opposed side portions 22 are at a horizontal level which is even with, or lower than, the upper surface of the mattress 30. This is accomplished by grasping the control handle 74, which is accessible from one side of the assembly, and manually depressing it from the full line position shown in FIG. 5, to the position which is shown in dashed lines in FIG. 5.

When the control handle 74 is thus moved downwardly, the control lever 72 is concurrently pivoted downwardly and, by reason of its securement to the elongated control rod 70, causes this rod to undergo rotation about its longitudinal axis. As the control rod 70 rotates about its longitudinal axis, the lever plates 80 secured to its opposite ends undergo pivotation from the position shown in full lines in FIG. 5 to the position shown in dashed lines. It will be noted in observing FIG. 5 that this type of movement of the lever plate 80 causes the reciprocating rods 82 and 84 to undergo reciprocation in a direction such that the latching pins 64 are pulled inwardly toward the center of the frame 20, and are thus withdrawn from the latching pin channels 36 and from the openings 62 formed in the vertically extending tubular frame elements 60 at opposite sides of the frame 20.

Withdrawal of the latching pins 64 in this fashion releases each of the side portions 22 of the frame 20, so that the interconnected side portions can move downwardly with respect to the base portion 23 of the frame 20. Such downward movement of the side portions 22 of the frame 20 can continue by sliding movement of the vertically extending tubular frame elements 60 in the centrally bored collar elements 40 until the lower longitudinally extending frame members 54 contact the upper side of the respective collar elements 40. At this point, further downward movement of the side portions 22 of the frame 20 is arrested, and in this status, the upper longitudinally extending frame elements have been lowered to a level such that they are below the upper surface of the mattress 30. A patient may then, if he is able, sit up and move off the mattress 30 to walk or be assisted to another location.

The extent to which the control handle 74 can be pivoted downwardly, and accordingly, the extent to which the control rod 70 can be rotated about its longitudinal axis, is limited by the relative positions of the stop rods 88 and 89 carried on the transversely extending horizontal bars 68 and the control rod 70, respectively. At a point where these stop rods come into contact with each other, no further rotative movement of the elongated control rod 70 can occur and thus, the latching pins 64 cannot be completely withdrawn from the latching pin passageways 44 which are provided through the several structural elements which house and slidably retain the latching pins.

When the bathing assembly is to be used for bathing a patient or incapacitated person, the flexible water repellant sheet 90 is first extended across the upper side of the mattress 30 and beneath the patient in a manner similar to the technique presently used for placing clean sheets under a bedfast patient. Such techniques are well known in the art. After the flexible water repellant sheet 90 has been placed over the mattress 30 and beneath the patient, the side frame portions 22 of the frame 20 are elevated by pulling upwardly on the upper longitudinally extending tubular frame elements 52 at opposite sides of the assembly. This will cause the vertically extending tubular frame elements 60 to slide upwardly in the respective bores 42 formed in the centrally bored collar elements 40. Such upward movement will continue until the holes 62 formed in the lower end portions of each of the vertically extending tubular frame elements 60 is opposite, and in alignment with, one of the respective latching pins 64. At this time, each latching pin 64 will snap outwardly into the aligned hole in the vertically extending tubular frame element 60 to lock the side frame portions 22 in their elevated position as shown in FIG. 5. The snap engagement of the latching pins 64 with the holes in the respective vertically extending tubular frame element 60 which is opposite each latching pin at this time is caused to occur by the retraction of the lever plates 80 to their full line position as shown in FIG. 5 by the resilient bias imparted thereto by the compression springs 86.

Once the side frame portions 22 have been elevated in the manner described, and have been locked in their elevated positions by the automatic latching action of the latching pins 64, the outer edges of the flexible, water repellant sheet of material, which preferably carries a plurality of spaced eyelets or grommets along the outer edges thereof, are connected to the opposed upper longitudinally extending tubular frame elements 52. This is accomplished by hooking the eyelets or grommets over hooks or protuberances 55. In this manner, a tub or open top container is formed by the flexible water repellant sheet 90, with the end thereof which is adjacent the foot of the mattress 30 open. As previously explained, a portion of the flexible water repellant sheet 90 depends downwardly, and can be draped over the side of the bathtub to permit drainage into the bathtub. It should be pointed out that the entire frame 20 of the assembly can be elevated or lowered by means of the hydraulic lift subassemblies 14 to adjust the elevation of the mattress 30 and overlying flexible water repellant sheet 90 to whatever level may be desired.

After bathing of the patient has been completed, the flexible sheet 90 can be wiped dry, if desired, and the side portions 22 of the frame 20 can be lowered in the manner previously explained, i.e., by manually depressing the control handle 74 to withdraw the latching pins 64 from the receiving openings 62 formed in the lower end portions of the vertically extending tubular frame elements 60. After the side frame portions 22 have been thus lowered, the flexible water repellant sheet 90 can be removed from over the mattress and beneath the patient, and the patient once again then rests upon the dry surface of the mattress.

Although a preferred embodiment of the invention has been herein described in order to illustrate the principles of structure and operation which characterize the invention, it is to be understood that the basic principles which underlie the invention can be incorporated in other forms of structure. Variations and changes of this type, which continue to rely upon basic principles of the invention, are therefore contemplated to be within the spirit and scope of the invention, except as the same may be necessarily limited by the appended claims when they are accorded a reasonable interpretation and range of equivalents.

What is claimed is:

1. An invalid bathing assembly comprising:

an adjustable bed frame including a pair of opposed, substantially parallel side portions and a horizontally extending bottom portion;

a mattress supported on the bottom portion between the side portions of the frame;

a water deflecting flexible sheet detachably connected to the opposed side portions of the frame and covering the mattress for retaining water for bathing an individual in said assembly;

means for selectively elevating and lowering the side portions of the frame relative to said bottom portion; and means for elevating and lowering the entire bed frame.

2. An invalid bathing assembly as defined in claim 1 wherein said means for selectively elevating and lowering said side portions comprises:

an elongated control rod;

means projecting from the control rod for manually rotating the control rod about its axis;

means engageable with said side portions of the frame when the side portions are in an elevated position relative to the bottom portion; and means interconnecting the control rod with said means engageable with said side portions for extending said engaging means into engagement with said side portions when said control rod is rotated to a first position, and for retracting said engagement means out of engagement with said side portions when said control rod is rotated to a second position.

3. An invalid bathing assembly as defined in claim 2 and further characterized to include means for preventing rotation of said control rod about its axis past said second position.

4. An invalid bathing assembly as defined in claim 1 and further characterized as including a base platform;

means supporting said base platform for rolling movement on a floor or the like;

and wherein said means for elevating and lowering the entire bed frame comprises hydraulic piston and cylinder assemblies extending between said base platform and said bottom portion of said frame.

5. An invalid bathing assembly as defined in claim 1 and further characterized as including transverse connecting frame members extending between and interconnecting said opposed, substantially parallel side portions of said elongated bed frame at one of the aligned ends of said side portions.

6. An invalid bathing assembly as defined in claim 1 wherein said bottom portion of said bed frame comprises:

a pair of opposed, elongated substantially parallel longitudinally extending tubular frame members;

a pair of horizontally extending, transverse tubular frame members interconnecting opposite ends of said longitudinally extending tubular frame members; and additional transverse tubular frame members disposed intermediate the ends of said longitudinal frame members and interconnecting intermediate portions of said longitudinal frame members.

7. An invalid bathing assembly as defined in claim 1 wherein said mattress is further characterized in including an elevated headrest portion adjacent one end thereof disposed beneath said water deflecting flexible sheet.

8. An invalid bathing assembly as defined in claim 6 and further characterized as including centrally bored collar elements secured to each of said longitudinally extending frame members at longitudinally spaced locations therealong and each slidingly receiving a portion of one of said side portions of said adjustable bed frame.

9. An invalid bathing assembly as defined in claim 8 wherein each of said side portions of said adjustable bed frame comprises:

a pair of vertically spaced, elongated, horizontal, longitudinally extending tubular frame elements; and a plurality of vertically extending frame elements extending between and interconnecting said vertically spaced longitudinally extending tubular frame elements and extending slidingly into said collar elements.

10. An invalid bathing assembly as defined in claim 2 wherein said means engageable with said side portions of the frame when the side portions are in an elevated position relative to the bottom portion comprises:

a plurality of latching pins;

and said means interconnecting said control rod with said engaging means comprises:

a plurality of reciprocating rods each having one of its ends connected to one of said latching pins;

a lever plate keyed to said control rod for rotation with said control rod about its axis, and connected to the second end of each of said reciprocating rods for reciprocating said reciprocating rods when said lever plate is rotated with said control rod about the axis of said control rod; and means resiliently biasing said lever plate to a position in which said latching pins are disengaged from said side portions.

11. An invalid bathing assembly as defined in claim 2 wherein said means projecting from said control rod comprises:

a control lever extending transversely across and under the bed frame; and a handle on the end of said control handle.

12. An invalid bathing assembly as defined in claim 1 wherein said water deflecting flexible sheet is a canvas sheet having grommets secured therein along the outer peripheral edges, and wherein assembly further includes hooks secured to upper portions of said parallel side portions and engaging said grommets.

13. An invalid bathing assembly as defined in claim 9 wherein said bed frame is open at one end above said mattress, and the upper one of the vertically spaced, elongated, horizontal longitudinally extending tubular frame elements in each pair thereof in the side portions of the frame curves downwardly to the horizontal level of said bottom portion at the open end of said frame.

14. An invalid bathing assembly as defined in claim 13 and further characterized as including transverse connecting frame members interconnecting each of the longitudinally extending tubular frame elements in each of said frame side portions to the longitudinally extending tubular frame elements in the other of said frame side portions.

15. An invalid bathing assembly as defined in claim 2 and further characterized as including:

a base platform;

means supporting said base platform for rolling movement on a floor or the like;

and wherein said means for elevating and lowering the entire bed frame comprises hydraulic piston and cylinder assemblies extending between said base platform and said bottom portion of said frame.

16. An invalid bathing assembly as defined in claim 15 and further characterized as including collar elements secured to opposite sides of said bottom portions at opposite ends of said frame and slidably receiving said side portions.

17. An invalid bathing assembly as defined in claim 16 wherein each of said side portions comprises:

a pair of vertically spaced, elongated, horizontal, longitudinally extending tubular frame elements; and a plurality of vertically extending frame elements extending between and interconnecting said vertically spaced longitudinally extending tubular frame elements and extending slidingly into said collar elements.

18. An invalid bathing assembly as defined in claim 17 wherein said means engageable with said side portions of the frame when the side portions are in an elevated position relative to the bottom portion comprises:

a plurality of latching pins;

and said means interconnecting said control rod with said engaging means comprises:

a plurality of reciprocating rods each having one of its ends connected to one of said latching pins;

a lever plate keyed to said control rod for rotation with said control rod about its axis, and connected to the second end of each of said reciprocating rods for reciprocating said reciprocating rods when said lever plate is rotated with said control rod about the axis of said control rod; and means resiliently biasing said lever plate to a position in which said latching pins are disengaged from said side portions.

* * * * *